US005807155A

United States Patent [19]

Divvleeon

[11] Patent Number: 5,807,155

[45] Date of Patent: Sep. 15, 1998

[54] PICTURE DISPLAY PLUSH TOY

[76] Inventor: Tametha Jean Divvleeon, 1908 Chimney La., 2A, Kettering, Ohio 45440

[21] Appl. No.: 835,331

[22] Filed: Apr. 7, 1997

[51] Int. Cl.[6] ..... A63H 3/02

[52] U.S. Cl. ..... 446/73; 446/369

[58] Field of Search ..... 446/369, 268, 446/73, 72, 74, 372, 901, 390

[56] References Cited

U.S. PATENT DOCUMENTS

| | | | |
|---|---|---|---|
| 1,445,368 | 2/1923 | Street et al. | 446/73 |
| 3,837,111 | 9/1974 | Godfrey et al. | 446/73 |
| 4,968,279 | 11/1990 | Smith | 446/369 X |
| 5,059,149 | 10/1991 | Stone | 446/73 |
| 5,326,300 | 7/1994 | Sounders | 446/74 |
| 5,344,356 | 9/1994 | Pizzelli | 446/73 |
| 5,453,307 | 9/1995 | Rezmer . | |
| 5,607,337 | 3/1997 | Callahan | 446/369 |

*Primary Examiner*—Robert A. Hafer
*Assistant Examiner*—Laura Fossum
*Attorney, Agent, or Firm*—Michael I. Kroll

[57] ABSTRACT

A picture display plush toy (10) having a three dimensional plaything figure (12). A plurality of pictorial items (14) are provided. A structure (16) is for holding each pictorial item (14), so that each pictorial item (14) is visible therefrom. A facility (18) is for attaching each holding structure (16) onto various locations of an exterior surface (20) of the three dimensional plaything figure (12), so that each pictorial item (14) can be seen thereon.

2 Claims, 4 Drawing Sheets

PICTURE DISPLAY PLUSH TOY

BACKGROUND OF THE INVENTION

1. Field of the Invention

The instant invention relates generally to decorative devices and more specifically it relates to a picture display plush toy. The picture display plush toy is a stuffed teddy bear animal having pictures carried in heart shaped picture frames attached all over the body of the stuffed teddy bear animal.

2. Description of the Prior Art

Numerous decorative devices have been provided in prior art. For example, U.S. Pat. Nos. 5,059,149 to Stone; 5,326,300 to Sonders; 5,344,356 to Pizzelli et al. and 5,453,307 to Rezmer all are illustrative of such prior art. While these units may be suitable for the particular purpose to which they address, they would not be as suitable for the purposes of the present invention as heretofore described.

STONE, TIMOTHY J.

STUFFED ANIMAL WITH BOOK ENCLOSURE APPARATUS

U.S. Pat. No. 5,059,149

A stuffed animal apparatus includes one or more storage compartments, in which visual and/or audio materials may be stored and/or displayed. The storage compartments are disposed in the stuffed animal body or in an appendage. An external storage compartment is shown secured to an appendage. The storage compartments may need flap coverings or they may be a pouch and they may be large or small, as desired.

SONDERS, SCOTT

COMBINATION CARRYING DEVICE AND TOY

U.S. Pat. No. 5,326,300

A combination carrying device and toy including a body having an exterior surface defining a toy-like structure and having interior surfaces defining at least one hollow body cavity being sufficiently sized to contain and carry desired baby accessories. At least one entry panel forms a portion of the exterior surface, the entry panel providing access to the hollow body cavity. The entry panel is fastened in a desired orientation relative to the exterior surface. Preferably, the body is in the shape of an ostensibly stuffed animal, such as a bear.

PIZZELLI, DAVID A.

GROOME, PAUL W.

PIZZELLI, CHARLES E.

DECORATIVE TOY AND STORAGE UNIT WITH ATTACHABLE HOLDERS

U.S. Pat. No. 5,344,356

A toy with VELCRO covering the visible surface, and holders also with VELCRO areas. The holders are arranged as receptacles for small items, such as hair bows, combs and barrettes, and the holders may be attached to the toy in decorative, playful and creative ways providing a combination toy and decorative storage facility. The toy is preferably a stuffed animal.

REZMER LEONARD D.

HORN MOUNT WITH DISPLAY PORTION

U.S. Pat. No. 5,453,307

A mount for displaying horns of an animal has a base member. The base has a display portion formed therein. The display portion comprises an opening and a recess formed in the base and in communication with each other. A cover and a backing enclose a photograph or other pictorial to be displayed in the display portion. The cover and backing fit within the recess, but may not pass forwardly into the opening. A nail slot may be provided to facilitate hanging of the mount to a wall or other surface.

SUMMARY OF THE INVENTION

A primary object of the present invention is to provide a picture display plush toy that will overcome the shortcomings of the prior art devices.

Another object is to provide a picture display plush toy that is a good way for a child to display pictures to help show the value of photographs.

An additional object is to provide a picture display plush toy that is a stuffed teddy bear animal, in which the child can hold, squeeze and play with, while at the same time there will be less damage applied to pictures carried in heart shaped picture frames attached all over the body of the stuffed teddy bear animal.

A further object is to provide a picture display plush toy that is simple and easy to use.

A still further object is to provide a picture display plush toy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of the instant invention being a stuffed teddy bear animal.

FIGURE 1*a* is an enlarged perspective view of an area in FIG. 1 indicated by arrow 1*a*, showing a heart shaped picture frame case opened and attached to the bottom of the left foot.

Similar reference characters denote corresponding features consistently throughout the attached drawings.

DETAILED DESCRIPTION OF THE PREFERRED EMBODIMENTS

Figure 1:
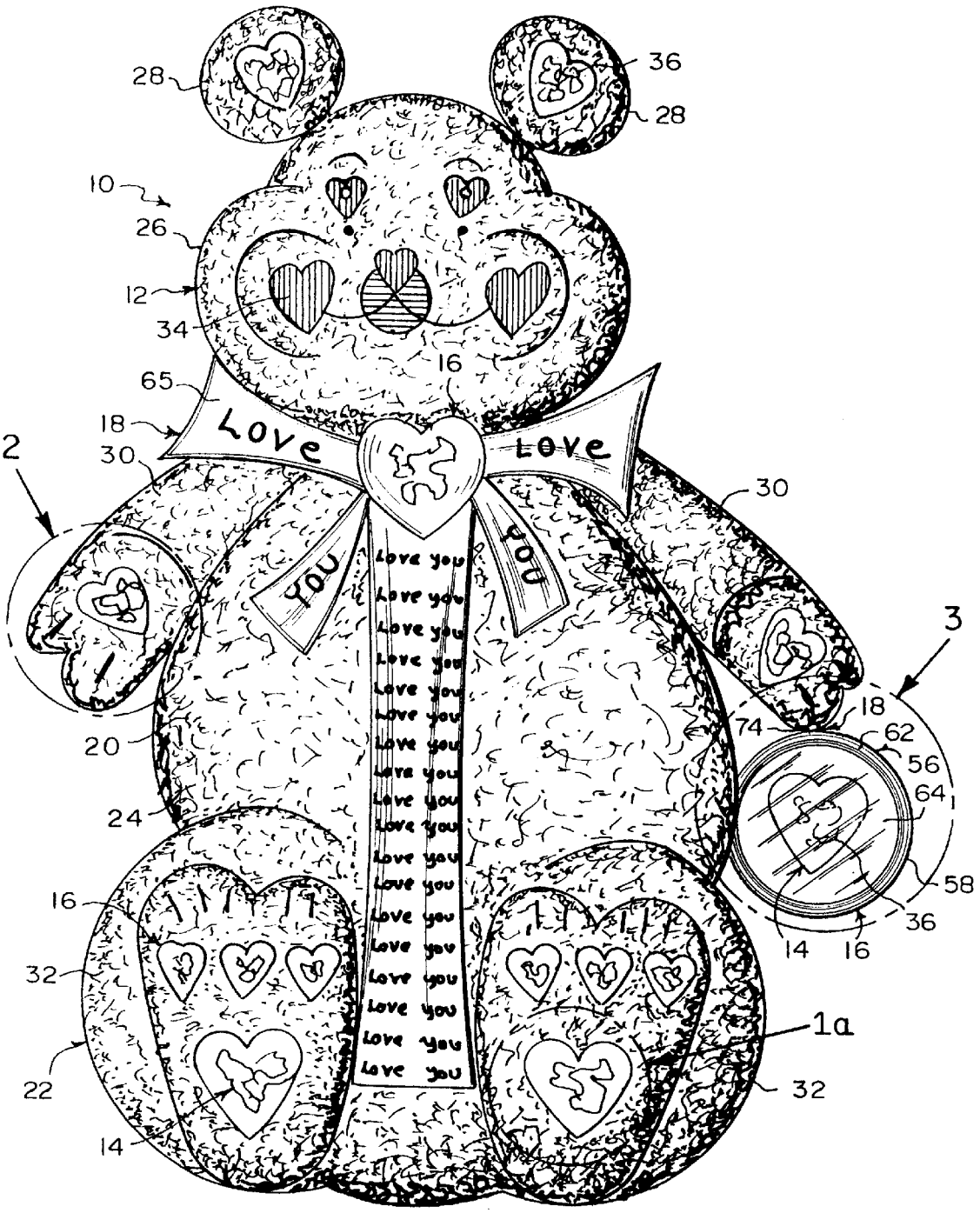

Turning now descriptively to the drawings, in which similar reference characters denote similar elements throughout the several views, FIGS. 1 to 5 illustrate a picture display plush toy 10 comprising a three dimensional plaything FIG. 12. A plurality of pictorial items 14 are provided. A structure 16 is for holding each pictorial item 14, so that each pictorial item 14 is visible therefrom. A facility 18 is for attaching each holding structure 16 onto various locations of an exterior surface 20 of the three dimensional plaything FIG. 12, so that each pictorial item 14 can be seen thereon.

The three dimensional plaything FIG. 12 is a stuffed teddy bear animal 22 in a sitting position. The stuffed teddy bear animal 22 includes a body 24 with a head 26 on the body 24. A pair of ears 28 are on the head 26. A pair of arms 30 are on the body 24, while a pair of legs 32 are also on the body 24.

The stuffed teddy bear animal 22 further contains a plurality of heart shaped objects 34 affixed onto the head 26, to represent a pair of eyes, a nose and a pair of cheeks. Each pictorial item 14 is a photograph 36.

Figures 1A, 2:
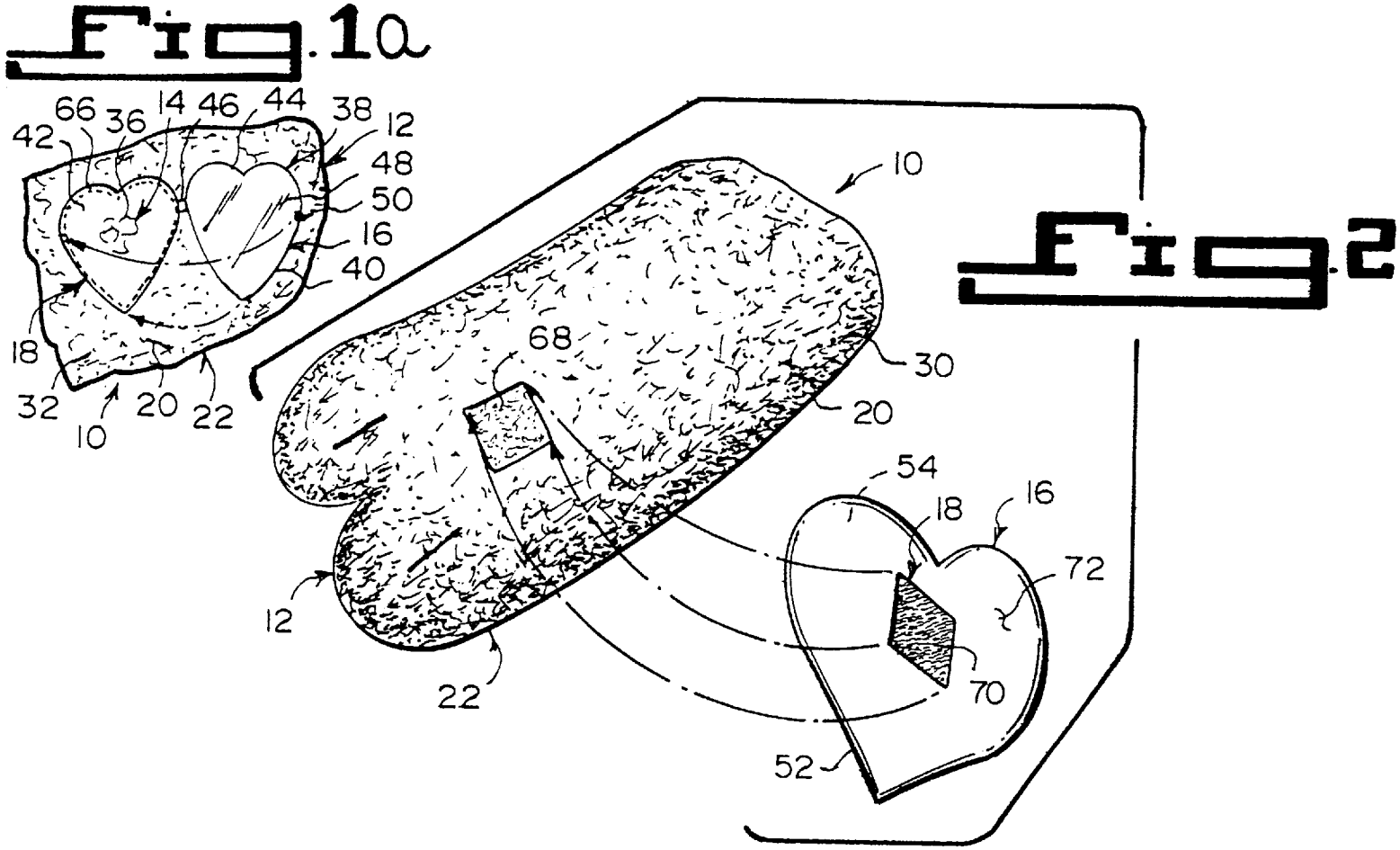
FIG. 2 is an enlarged perspective view of an area in FIG. 1 indicated by arrow 2, showing a heart shaped picture frame exploded from the right hand to see the VELCRO fastener.

One of the holding structures 16, as shown in FIG. 1*a*, is a heart shaped picture frame 38 to retain one pictorial item 14 therein. The heart shaped picture frame 38 is a case 40, which consists of a base 42 to hold the pictorial item 14 thereto. A bezel 44 is hinged at 46 to the base 42. A crystal 48 is carried in the bezel 44. A latch mechanism 50 is between the base 42 and the bezel 44, to maintain the bezel 44 with the crystal 48 in a closed position on the base 42 after the pictorial item 14 is placed onto the base 42, so as to protect the pictorial item 14.

Figure 3:
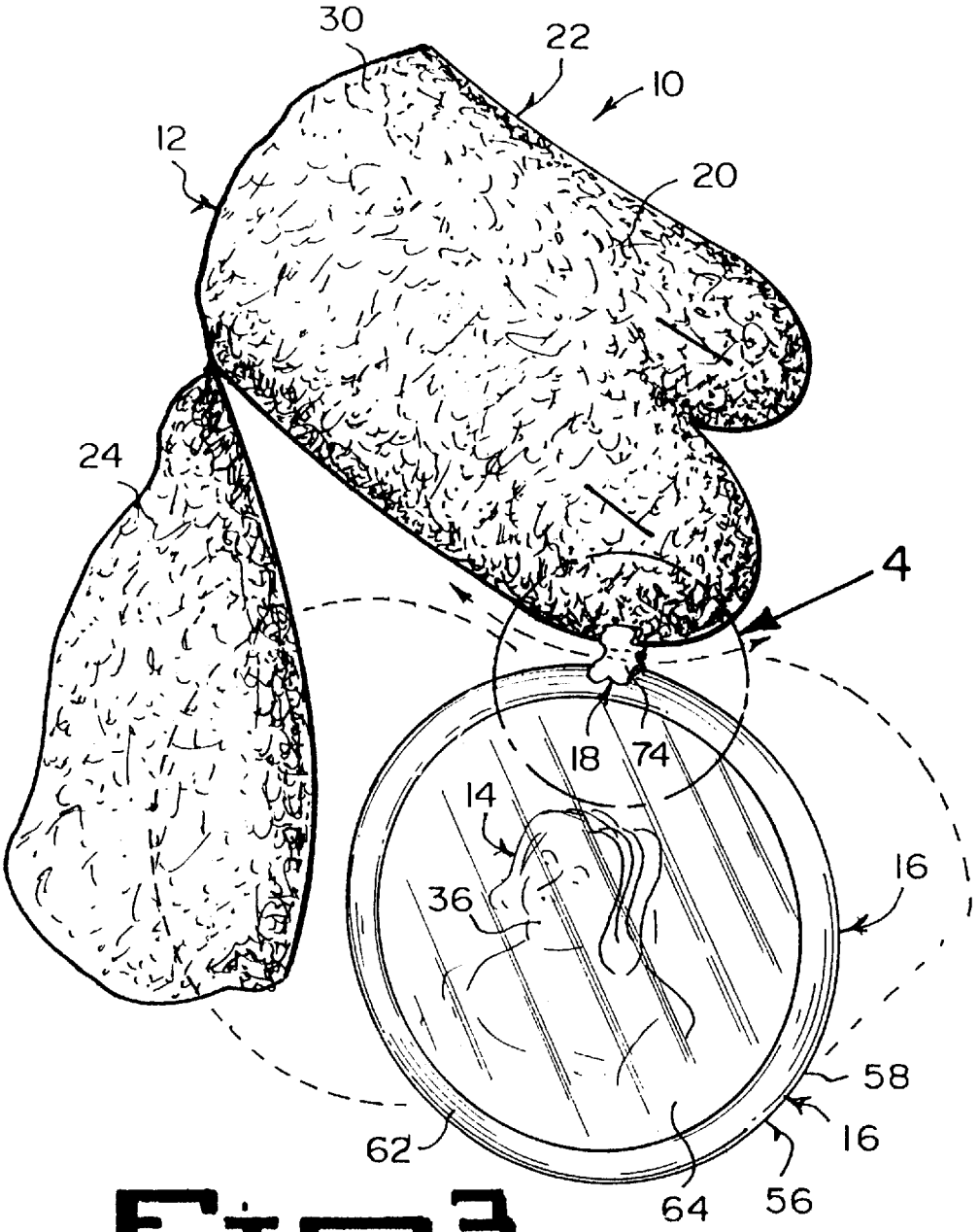
FIG. 3 is an enlarged perspective view of an area in FIG. 1 indicated by arrow 3, showing in greater detail, a circular shaped picture frame locket held onto the left hand.
Figure 4:
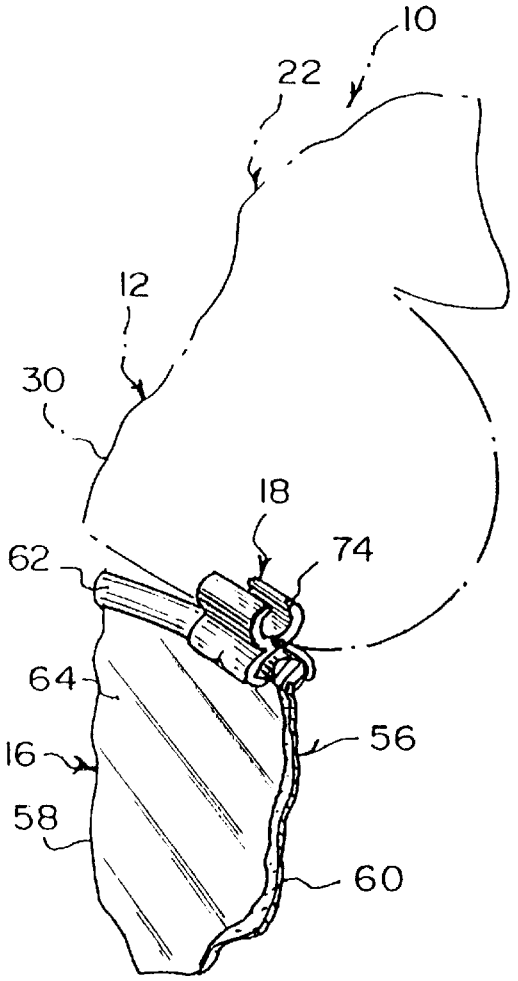
FIG. 4 is an enlarged perspective view of an area in FIG. 3 indicated by arrow 4 with parts broken away and in phantom, showing the double clip member and the circular shaped picture frame locket construction in greater detail.

One of the holding structures 16, as best shown in FIG. 2, is a heart shaped picture plate 52 having adhesive 54 thereon to retain one pictorial item 14 thereto. One of the holding structures 16, as shown in FIGS. 1, 3 and 4, is a circular shaped picture frame 56 to retain one pictorial item 14 therein.

The circular shaped picture frame 56 is a locket 58, which includes a backing 60 to hold the pictorial item 14 thereto. A bezel 62 is affixed about the circumference of the backing 60. A crystal 64 is mounted into the bezel 62 over the backing 60, to protect the pictorial item 14 therebetween.

One of the attaching facilities 18, as shown in FIG. 1, is a ribbon 65 that can be tied as a bow between the body 24 and the head 26 of the stuffed teddy bear animal 22, so that a back surface of the holding structure 16 can be affixed onto the ribbon 65 and retained thereto. One of the attaching facilities 18, as shown in FIG. 1*a*, is a thread 66 sewn through the base 42 of the case 40 of the heart shaped picture frame 56 and into the exterior surface 20 of the three dimensional plaything FIG. 12.

Figure 5:
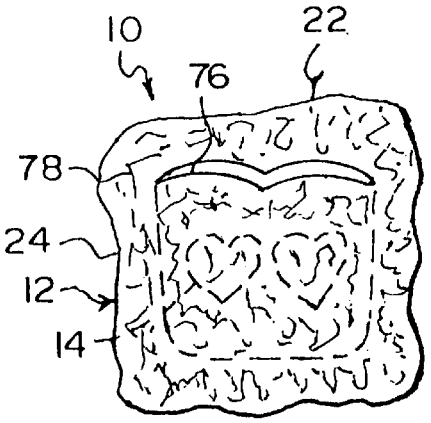
FIG. 5 is a rear view of a portion of the instant invention, showing a storage pouch to store extra pictorial items therein.

An attaching facility 18, as shown in FIG. 2, is a pair of VELCRO pads 68, 70. The first VELCRO pad 68 is affixed onto the exterior surface 20 of the three dimensional plaything FIG. 12. The second VELCRO pad 70 is affixed onto a rear surface 72 of the heart shaped picture plate 52, so that the first VELCRO pad 68 can mate with the second VELCRO pad 70. One of the attaching facilities 18, as shown in FIGS. 1, 3 and 4, is a double clip member 74 which can engage with the exterior surface 20 of the three dimensional plaything FIG. 12 and onto the bezel 62 of the locket 58 of the circular shaped picture frame 56. FIG. 5 shows a storage pouch 76 in a back portion 78 of the body 24 of the stuffed teddy bear animal 22, to store extra pictorial items 14 therein.

The holding structures 16 can be retained onto the ears 28, the arms 30 and the bottom of the feet of the legs 32 by the attaching facilities 18, to enhance the appearance of the stuffed teddy bear animal 22 with the pictorial items 14. The holding structures 16 will also protect the pictorial items 14 from damage, while allowing the pictorial items 14 to be viewed safely on the stuffed teddy bear animal 22.

LIST OF REFERENCE NUMBERS

10 picture display plush toy
12 three dimensional plaything figure of 10
14 pictorial item of 10
16 holding structure for 14 of 10
18 attaching facility for 16 of 10
20 exterior surface of 12
22 stuffed teddy bear animal for 12
24 body of 22
26 head of 22 on 24
28 ear of 22 on 26
30 arm of 22 on 24
32 leg of 22 on 24
34 heart shaped object of 22 on 26
36 photograph for 14
38 heart shaped picture frame for 16
40 case for 38
42 base of 40
44 bezel of 40
46 hinge between 42 and 44
48 crystal of 40 in 44
50 latch mechanism between 42 and 44
52 heart shaped picture plate for 16
54 adhesive on 52
56 circular shaped picture frame for 16
58 locket for 56
60 backing of 58
62 bezel of 58 on 60
64 crystal of 58 in 62
65 ribbon for 18
66 thread for 18
68 first VELCRO pad of 18
70 second VELCRO pad of 18
72 rear surface of 52
74 double clip member for 18
76 storage pouch
78 back portion of 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A picture display plush toy comprising:

a) three dimensional plaything figure means comprising a stuffed teddy bear having a head, ears, a body, arms, and legs in a sitting position for acting as a multi picture holder and display;

b) a plurality of pictorial items;

c) means for holding each said pictorial item, so that each said pictorial item is visible therefrom;

d) means for attaching each said holding means onto various locations of an exterior surface of said teddy bear, so that each said pictorial item can be seen thereon; and e) one of said holding means being a circular shaped picture frame to retain one said pictorial item therein, said circular shaped picture frame being a locket which includes a backing to hold said pictorial item, a bezel affixed about the circumference of said backing, and a crystal mounted into said bezel over said backing to protect said pictorial item therebetween, and one of said attaching means being a double clip member which engages the end of an arm of said stuffed animal and said bezel of said locket.

2. A picture display plush toy as recited in claim 1, further including a storage pouch in a back portion of said body of said stuffed teddy bear animal, to store extra pictorial items therein.

* * * * *